United States Patent [19]

Wilson

[11] 4,169,047

[45] Sep. 25, 1979

[54] FLOTATION MACHINE WITH MIXING AND AERATION IMPELLER AND METHOD

[75] Inventor: Robert A. Wilson, Salt Lake City, Utah

[73] Assignee: Baker International Corporation, Orange, Calif.

[21] Appl. No.: 795,004

[22] Filed: May 9, 1977

[51] Int. Cl.[2] ..... B03D 1/22

[52] U.S. Cl. ..... 209/164; 209/169; 209/170; 210/44; 210/221 P; 261/87; 261/93

[58] Field of Search ..... 261/84–88, 261/93; 209/164, 169, 170, 168; 210/44, 221 P, 221 M

[56] References Cited

U.S. PATENT DOCUMENTS

| | | | |
|---|---|---|---|
| 1,093,751 | 4/1914 | Wheeler | 261/87 |
| 1,242,445 | 10/1917 | Ihner | 261/87 |
| 1,949,696 | 3/1934 | Schoneborn | 261/93 |
| 2,433,592 | 12/1947 | Booth | 261/93 |
| 2,515,538 | 7/1950 | Wall | 261/93 |
| 2,609,097 | 9/1952 | Dering | 209/169 |
| 2,996,287 | 8/1961 | Audran | 261/87 |
| 3,070,229 | 12/1962 | Benozzo | 261/87 |
| 3,796,417 | 3/1974 | Kaelin | 261/93 |
| 3,843,101 | 10/1974 | Green | 210/221 M |
| 3,953,552 | 4/1976 | Strauss | 261/93 |

OTHER PUBLICATIONS

Galigher Bulletin A-075, Agitair Floatation Machine, 1975, pp. 1-9.

*Primary Examiner*—Frank W. Lutter
*Assistant Examiner*—Gregory N. Clements
*Attorney, Agent, or Firm*—Trask & Britt

[57] ABSTRACT

A mixing and aeration impeller is comprised of a hub and a plurality of first flutes interspaced between and joined to a plurality of second flutes. The flutes are adapted to the hub and have troughs which begin proximate the hub and extend radially away from and angularly downward and upward away from a plane normal to a shaft to which the impeller is adapted. The flutes are preferably formed as one unitary structure and shaped in a periodic pattern which may be generally sinusoidal or trapezoidal in cross section normal to the radius of the impeller along the length of the troughs. The impeller includes means to receive compressed air from a source and means to exhaust the compressed air radially outward from the rim. The hub has means to receive the compressed air and to communicate it to a passage or gap formed in the flutes to transmit the air radially outward to the rim. The air is exhausted through a slot along the rim of the impeller. A shroud with radial fins may be positioned about the impeller. The impeller used is the agitation means in a flotation machine for recovering mineral values. A method of agitation and aeration is also disclosed.

18 Claims, 5 Drawing Figures

FLOTATION MACHINE WITH MIXING AND AERATION IMPELLER AND METHOD

BACKGROUND OF THE INVENTION

1. Field

This invention relates to mixing and aeration impellers. Specifically this invention provides a method and apparatus for mixing and aerating mediums, includng slurries processed in flotation machines to recover mineral values therefrom.

2. State of the Art:

In recent years the mineral processing industry has found it necessary to treat ever increasing tonnages of lower and lower grade ores. This, in turn, has dictated the use of correspondingly increasingly large processing equipment, including flotation machines.

A slurry is prepared from a ground mixture of ore and a liqid which is typically water with selected conditioning, collecting and frothing agents. The slurry is fed into a flotation machine comprised of one or more flotation cells. In the flotation cells, means are typically employed to both aerate and physically mix the slurry. Aeration and mixing are desired to simultaneously produce bubbles in the slurry and to bring ore particles in contact with the bubbles. As is known, ore particles having desired mineral values tend to be carried to the surface of the slurry to form a forth which may be regarded as a concentrate of the desired mineral value to be recovered. As known, in the flotation process, some particles, which tend to be the heavier particles which are frequently rich in the desired mineral value, tend to settle to the bottom of the flotation cell. In order to improve the efficiency of the flotation machine process it is desirable to thoroughly mix and suspend all particles in the slurry without overmixing or agitating which could reduce the opportunity for bubbles to transport desired particles to the surface (froth).

Heretofore the mixing operation within the flotation cell has been effected by a variety of mixing means. For example, a ship-type propeller could be used within the slurry. It would be rotated to produce a generally downward flow and in turn generate a circulating current which is deflected from the bottom of the cell. However, such a propeller would not usually be reversible to vary the flow currents within the cell to minimize the collection of solids near the bottom of the cell. Such limitation would be more severe when the ship-type propeller is used with means for the introduction of gas to enhance mixing. Further, the flow currents above the propeller are less pronounced. In turn, mixing is less effacious. Moreover, solids could build-up on the cell bottom in the flow vortex. A ship-type propeller may be more readily subject to the build-up of corrosion and precipitates on the propeller blades.

Turbine-type impellers have been used in flotation cells and can be either unidirectional or reversible (in rotation) depending upon the design of the impeller blades. However, the flow patterns through such an impeller are such that the bottom of the cell cannot be readily swept by flow to prevent the build-up of solids on the bottom which settle out from the slurry.

Modern aeration impellers in common use (e.g., those manufactured by the Galigher Co. of Salt Lake City, Utah, and sold under the trademark "AGITAIR") can be reversed to improve impeller life. Flow through such impellers is generally upward under and downward to the impeller and then radially outward. The flow currents along the bottom of the cell are not pronounced. In turn, mixing is less thorough because a direct outward flow of fluid is not directed at the bottom to sweep it clean and keep the heavier particulate matter suspended in the slurry.

Injecting gas into such an impeller is effected so that a slurry gas mixture is pumped by the turbine blades. The gas fluid interfaces tend to accelerate erosion and, when the gas is chemically capable of contributing to corrosion (e.g., air), corrosion of the impeller. Further, the gas tends to decrease the efficiency of the impeller because it inhibits laminar flow and by its mere presence reduces the volume of slurry processed.

The Outokumpu OK-16 pneumatic flotation machine uses an impeller such as the one shown on page 148 of *Mining Magazine,* August 1976 (published by Mining Journal Ltd, London, England). Gas is directed into the fluid before it passes through the impeller blades. Impellers of this type also suffer increased erosion and corrosion across the turbine blades by virtue of the presence of the gas which is generally compressed air. Further, such an impeller does not direct a flow of slurry to the bottom to sweep the bottom of the cell. Therefore, not all matter is suspended within the slurry for processing. The processing of the slurry throughout the system is thus less efficient and in turn less economical.

U.S. Pat. No. 3,843,101 (Green) also discloses an impeller which may be regarded as a flotation machine impeller.

BRIEF DESCRIPTION OF THE INVENTION

An impeller for rotation by a shaft is comprised of a hub and a plurality of first flutes interspaced between and joined to a plurality of second flutes. The hub may be removably adapted to the shaft. The impeller rotates in a plane substantially normal to the shaft. The first and second flutes are adapted to the hub and extend radially outward from the hub. Each of the flutes has a trough beginning proximate the hub which extends angularly downward for the first flutes and angularly upward for the second flutes as the flutes extend radially outward. The bases of the flutes form the outer rim of the impeller.

The impeller preferably includes means to receive compressed air from a source and means to exhaust the compressed air radially outward from the rim. The hub may be formed to receive air from a hollow shaft and communicate it to at least one passage formed through at least one flute to the outer rim of the impeller. A plurality of passages may be formed in the impeller which have distal ends at the outer rim. The distal ends may be preferably interconnected to form a continuing slot along the rim. Most preferably the impeller is formed from upper and lower substantially symmetrical members positioned proximate each other to form a gap which is connected to receive compressed air from the hub and to form a continuing slot along the outer rim of the impeller.

The impeller has a height measured in the axial direction at its outer rim. Preferably the impeller has a diameter to height ratio from about twenty to one (20:1) to about one to one (1:1). The first and second flutes are preferably formed as one unitary structure and shaped in a periodic pattern. They may be smoothly shaped to be generally sinusoidal in shape at the rim and in cross section normal to the radius of the impeller along the length of the flutes. They may also be shaped to form a trapezoid having substantially equal vertical side members in cross section normal to the radius of the impeller along the length of the flutes. The flutes are preferably formed from a strong and slightly flexible material. Further, the impeller may have a shroud positioned above and below the impeller proximate thereto. The shroud may include a plate in a plane normal to the shaft with support means adapted thereto and a plurality of fins adapted thereto. The fins are radially oriented about the perimeter of the impeller.

A flotation machine for recovering mineral values has a cell containing a slurry and means to agitate the slurry. An improved impeller is used which constitutes the agitation means. The impeller rotates in a plane substantially normal to its rotation shaft. The impeller has hub means and a plurality of first flute means interspaced between a plurality of second flute means. Preferably the impeller has means to receive compressed gas and means to exhaust the gas into the slurry along the rim of the impeller.

The slurry in a flotation machine may be agitated by rotating an impeller within the slurry to cause the slurry to be simultaneously directed angularly upward and angularly downward from the impeller. The rate of rotation of the impeller is selected to establish separate slurry flow currents above and below the impeller. By positioning the impeller properly within the cell of a flotation machine, one current is directed to the bottom of the cell to sweep across the bottom and the other is directed upward towards the surface of the cell. The suction for the flow upward is from below the impeller; and the suction for the flow downward is from above the impeller.

Preferably the impeller is selected to have a diameter to height ratio between about 20:1 and about 1:1. Most preferably, the impeller is selected to have a diameter to height ratio between about 10:1 and about 1:1 when positioned within a cell sized so that the cell cross-sectional width to impeller diameter ratio is between about 1½:1 and about 10:1. Further, the impeller is preferably rotated at a rate so that the peripheral speed is between about two (2) meters per second and about fifteen (15) meters per second.

BRIEF DESCRIPTION OF THE DRAWINGS

In the drawings, which illustrate the best mode presently contemplated for carrying out the invention.

DESCRIPTION OF THE ILLUSTRATED EMBODIMENT

Figure 1:
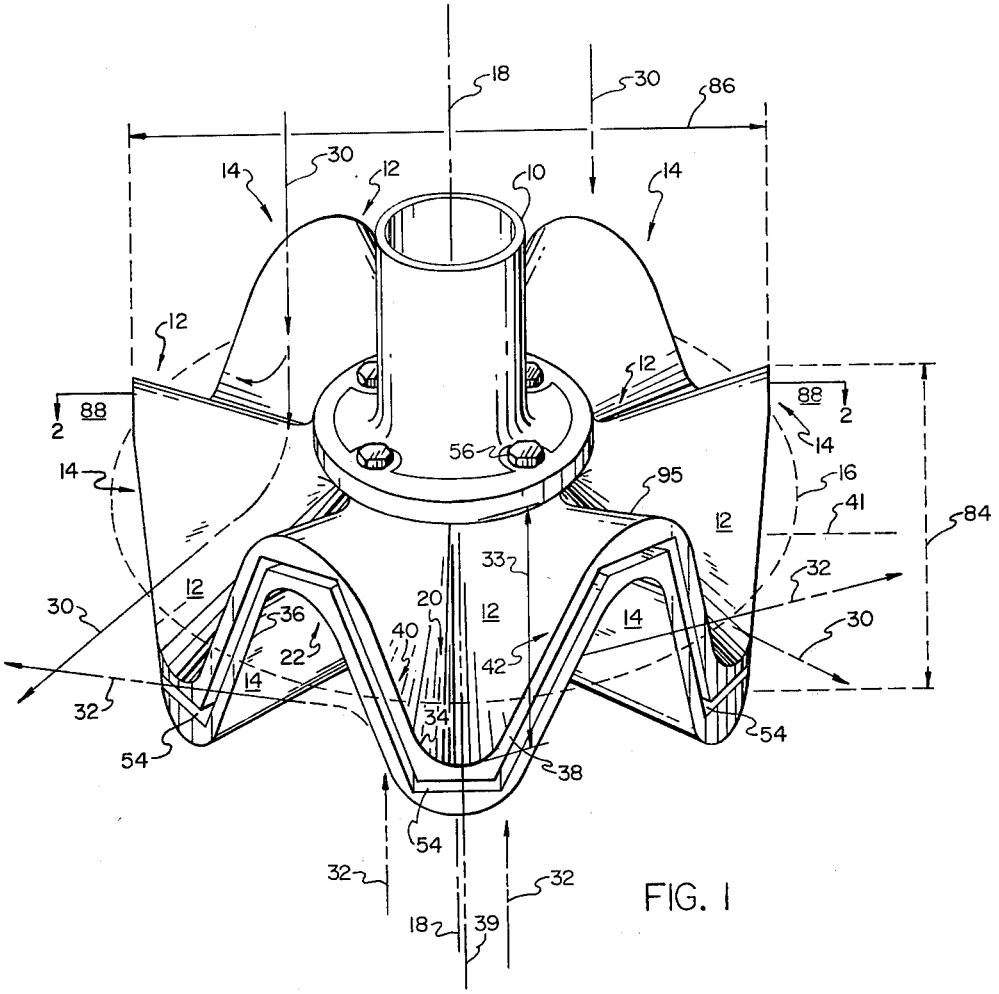
FIG. 1 is a perspective side view of an impeller of the instant invention.

The agitation and aeration impeller shown in FIG. 1 has a hub 10 and a plurality of first flutes 12 interspaced and connected between a plurality of second flutes 14. The hub 10 constitutes hub means for removably adapting the impeller illustrated in FIG. 1 to a shaft (not shown). The shaft provides rotational torque to rotate the impeller of FIG. 1 in a plane 16 which is substantially normal to the axis 18 of the hub 10 and shaft (not shown).

Figure 2:
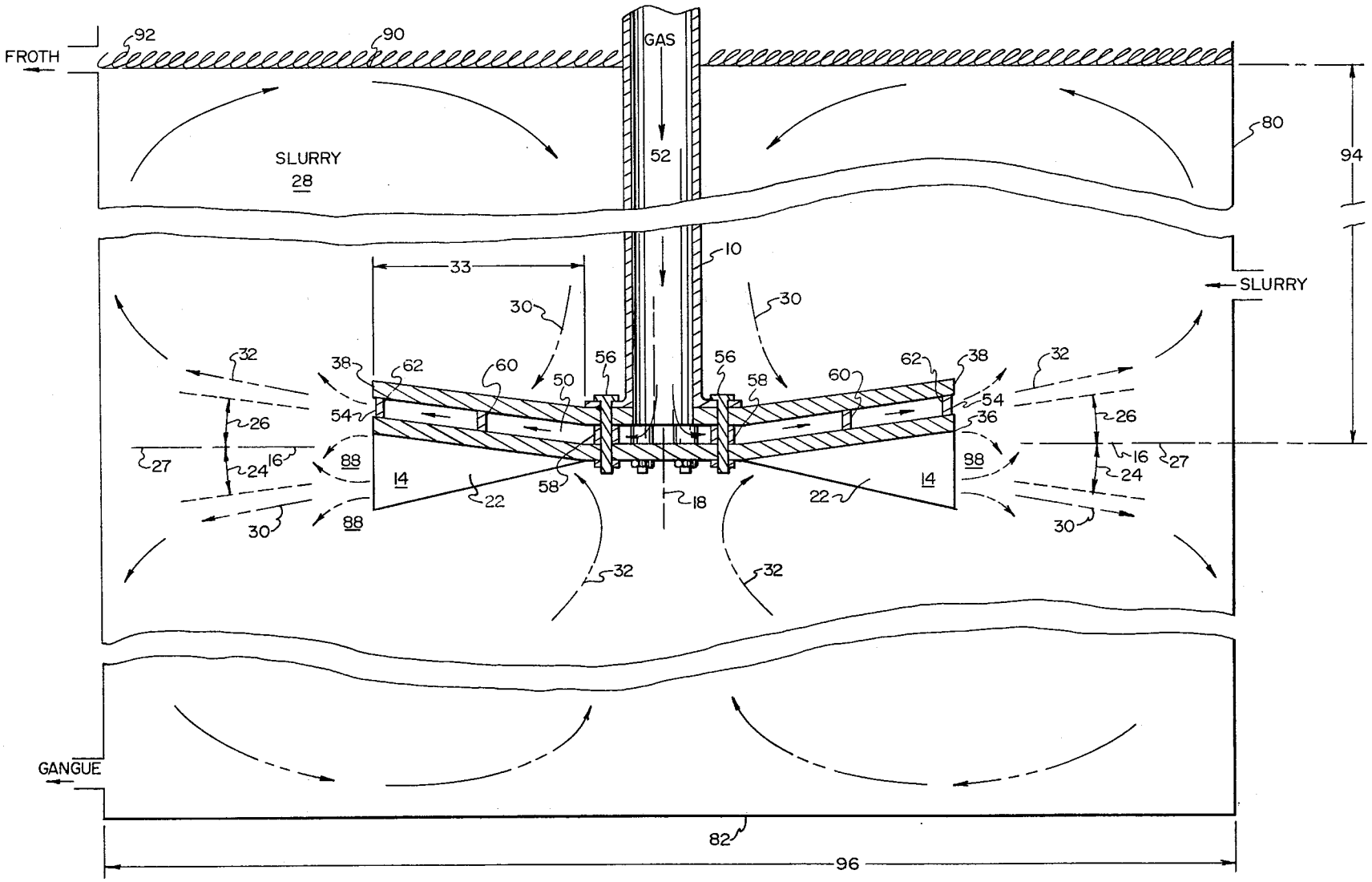
FIG. 2 is a cross-sectional side view of an impeller within a flotation machine cell of a flotation machine of the instant invention.

The first flutes 12 are provided with a trough 20 which commences proximate the hub 10 and extends radially and downwardly away from the plane 16. Similarly, the second flutes 14 contain a trough 22 which commences proximate the hub and extends radially and upwardly away from the plane 16. As best seen in FIG. 2, the troughs 20 and 22 of the first and second flutes 12 and 14 extend downwardly and upwardly at a discrete acute angle 24 and 26 with respect to the plane 16. The angles 24 and 26 are here shown to be equal with a common base 27. Upon rotating an impeller of the type illustrated in FIGS. 1 and 2 in a medium such as a slurry 28, it has been found that flow is directed from the first flutes 12 downward as indicated by the arrow 30 and by the second flutes upward as indicated by the arrow 32. As more fully discussed hereinafter, the flow pattern above and away from and downward away from the plane 16 of the impeller results in improved agitation.

As best seen in FIG. 1, the flutes 12 and 14 are formed as a unitary structure with the bases 34 and 36 of the flutes forming a substantially circular (in projection) rim 38. The flutes 12 and 14 may be formed to be smooth, continuous surfaces which may be regarded as generally sinusoidal in appearance. That is, a cross-section normal to the radius 41 of the impeller along the length 33 of the flutes 12 and 14 would result in the wavy shape which may be regarded as generally sinusoidal. A smooth contiguous surface is desirable to reduce drag as the impeller is rotated and to avoid the build-up of deposits. Further, a smooth contiguous surface tends to minimize the corrosion and erosion which might be experienced in a slurry environment.

Figure 3:
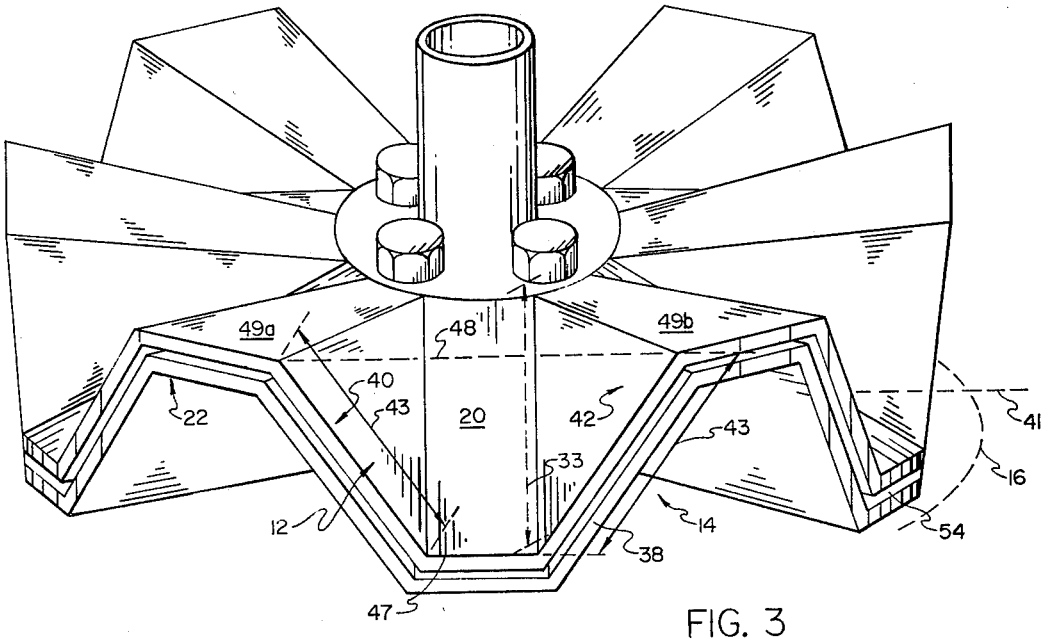
FIG. 3 is a side perspective side view of an impeller of the present invention.

Referring to FIG. 3, the impeller therein illustrated has flutes 12 and 14 formed to be essentially trapezoids with sides 40, 42 substantially equal in vertical length 43 in cross section normal to the radius 41 along the length 33 of the flutes 12, 14. That is, a cross section normal to the radius 41 of the impeller in the plane 16 would show a trapezoidal shape with the trapezoid having a base 47, equal vertical sides 40 and 42, and another base 48 which would be the line 48 interconnecting two adjacent flute vertical surface extremities **49*a* 49*b***. Here too a smooth surface is desired to reduce drag, to avoid build-up of deposits and to minimize corrosion and erosion.

It might also be noted that the flutes 12, 14 of FIGS. 1, 2 and 3 are each generally formed to be a periodic pattern about the hub 10. Further, each flute may be regarded as having an axis or center line 30 with surfaces 40 and 42 on either side formed to be substantially symmetric or mirror images of each other. Thus, the impeller of FIGS. 1 and 2 may be rotated either in a clockwise or counterclockwise direction as desired by the user. In practice, it may be desirable to operate the impeller in first clockwise direction for a period of time and then in a counterclockwise direction. In this way the surface erosion experienced by the impeller as the fluid (slurry 28) passes down and out of a particular flute (12, 14) will shift from one side 40 to the other side 42 of each flute 12, 14.

Referring in more detail to FIG. 2, which is a section of the impeller of FIG. 1 along the section lines 2—2, it can be seen that the hub 10 as illustrated is in effect an elongated hub or shaft extending upward away from the plane 16 for connection to a shaft and external rotation means. The hub 10 is hollow and receives a gas which is preferably a compressed gas such as air from an external source which transmits the gas down the length of the hub 10 in an axial direction towards the flutes 12, 14. It can further be seen that the flutes 12 and 14 are formed to have a passage which as here shown is a continuous gap 50 extending from the hub 10 outwardly to the rim 38 of the impeller. Although one or more passages may be employed to communicate the compressed gas 52 from the hub to the rim of the impeller, it is preferred to use the continuous gap 50 to form a continuous or an unbroken slot 54 along the outer rim of the impeller.

As best seen in FIG. 2, the flutes 12 and 14 are substantially congruent to each other and are formed as two substantially symmetrical members which are bolted to the hub 10 by a plurality of nuts and bolts 56. Spacers 58 are provided along the shafts of the bolts 56 to provide for the gap 50. Further additional spacers or supports 60 may be provided along the radial length of the gaps 50 to provide structural strength and minimize vibration. An end spacer 62 proximate the rim 38 may not be desired in some circumstances. In particular, it may be desirable to fabricate the flutes 12 and 14 from a strong yet flexible substance such as plastic elastomers or rubber compounds. Certain flexing in the flutes 12 and 14 has been found to be desirable to minimize the build-up of crud (i.e., solid scales adhering to the surfaces of the impeller).

Figure 5:
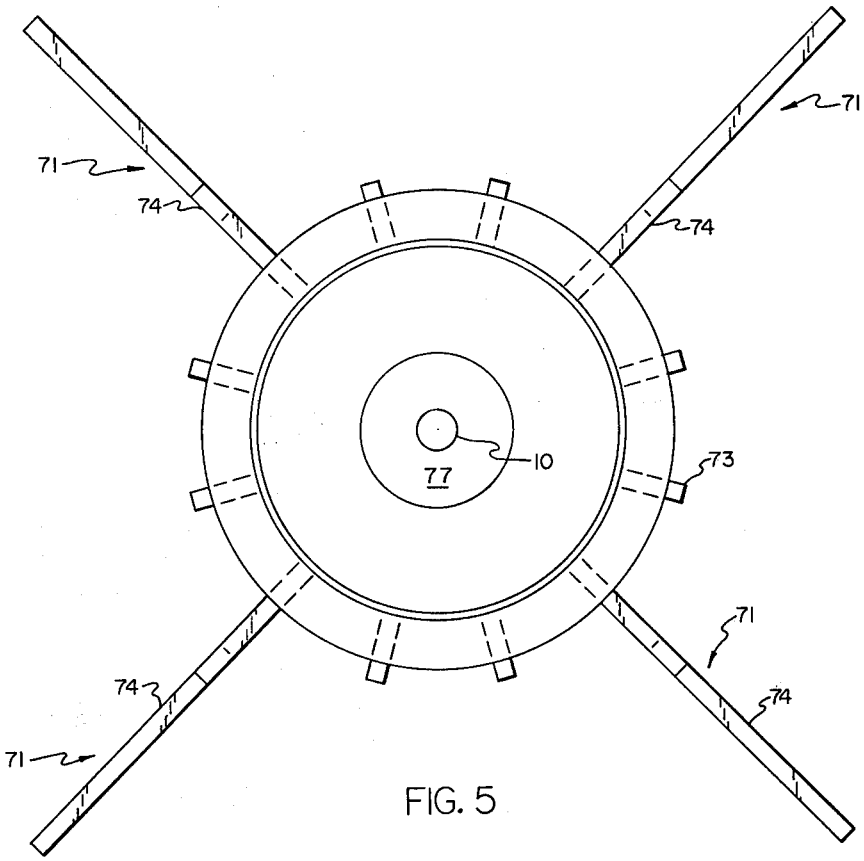
FIG. 5 is a top view of the impeller and shroud of FIG. 4.
Figure 4:
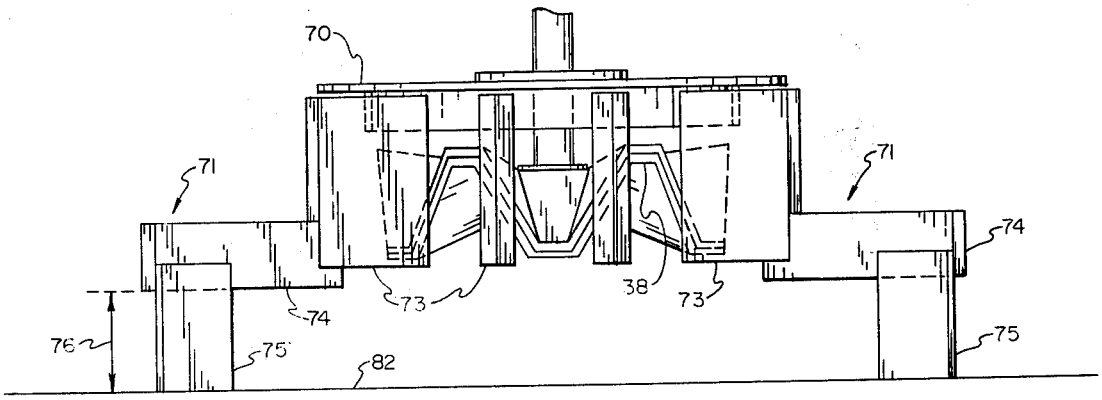
FIG. 4 is a side view of an impeller of the instant invention with shroud means positioned proximate thereto.

Referring to FIGS. 4 and 5, it can be seen that an impeller substantially similar to the impellers of FIGS. 1, 2 and 3 is illustrated with shroud means positioned proximate thereto. The shroud means includes a plate 70 and support means 71. The shroud plate 70, as here shown, has a plurality of fins 73 secured thereto. The fins are oriented radially and are positioned preferably symmetrically about the perimeter or rim 38 of the impeller. The support means 71 is comprised of an arm 74 and leg 75. Each arm 74 is secured to a fin 73. The legs 75 are sized in length 76 to support the shroud on the bottom 82 of a cell 80 (FIG. 2). Alternately, the support means 71 may be attached directly to the plate 70 and provided with structure to suspend it from above the impeller. An aperture 77 is formed in the plate 70 concentric to the hub 10 or shaft of the impeller to act as an inlet or suction for the impeller.

It should be particularly noted that the impeller of the instant invention (may be regarded as a double-fluted impeller) permits a cross mixing flow which tends to more thoroughly mix and suspend the particulate matter in a slurry 28. More particularly, the flow as the impeller is rotated is such that the fluid traveling axially upward towards the impeller, as shown by the double dot arrows 32, continues to pass upward away from the plane 16 as it exits the second flutes 14 and at the same time fluid traveling axially downward as shown by the single dash arrows 30 continues to pass downward as it exits the first flutes 12 angularly downward away from the plane 16. In this way fluid above the impeller is circulated downward and to the area below the impeller while at the same time fluid below the impeller is circulated upward to the area above the impeller. Thereby more thorough mixing and aeration is effected.

The cross mixing feature as best seen in FIG. 2 generates what might be regarded as a figure-eight flow pattern within the cell 80 of a flotation machine. By positioning the impeller of the instant invention and rotating it at a selected speed, flow exiting the first flutes 12 may be directed outwardly to the side of the cell 80 and then downward to the bottom 82 of the cell. The flow current so established in effect sweeps the bottom so that particulate matter in the slurry does not settle out and collect on the bottom of the tank. Indeed, as the flow passes or sweeps along the bottom 82 of the cell 80 and draws particulate matter into the slurry 28, the slurry is directed upward towards the top of the cell by the second flutes 14. Accordingly, a more complete mixing of the particulate matter in the slurry is effected with a minimum of segregation of the coarse and heavy particles which are not easily suspended by any of the other types of impellers presently known.

The cross mixing feature hereinbefore discussed, can be increased or decreased depending upon the desires of the user by changing impeller diameter to height ratio. In particular, the impeller of the instant invention may be regarded as having a height which is measured in the axial direction at the rim 38 of the impeller. That is, the distance between the uppermost portion and lowermost portion of adjacent flutes may be regarded as the height 84 of the impeller. It has been found that the impeller diameter 86 to impeller height 84 (FIG. 1) ratio may be varied from approximately 20:1 to 1:1. However, practical use in flotation of chemical applications has been found to be best in the range of ratios of about 10:1 to 1:1. Further, it has been noted that the more nearly the ratio approaches 1:1, the more effective is the intermixing of materials on each side of the impeller. That is, the agitation in the tank is more violent yet even and thorough.

As known to those skilled in the art, it is desirable to introduce a gas to both improving the mixing of the slurry 28 within the flotation machine and to provide bubbles to carry mineral value particles to the slurry surface 90 (FIG. 2) to form a froth 92. In the past, air or gas has been introduced in such a manner as to impinge directly on turbine blades or other impeller structure thereby significantly increasing the erosion experienced by that structure. In turn the wear life of an impeller has been significantly shortened and in turn the cost of the process increased. In the instant invention, gas (which may be compressed air) 52 is passed down a hollow shaft into the hub 10 and thence outwardly through the flutes 12, 14 to exit through the slot 54 at the rim 38 of the impeller in an outward radial direction. It may be noted that as the impeller is rotated through a medium such as the slurry 28, the increased flow of the medium at the rim 54 of the impeller as it exits the flutes 12 and 14 produces a reduced pressure area 88 immediately adjacent the rim 38. The gas 52 exits from the slot 54 into the reduced pressure area 88. Thus it may be seen that the pressure of the gas 52 is supplied may be reduced because it need not overcome the full pressure of the medium such as the slurry 28 as it exists at the depth 94 the impeller is located within the cell 80. This in turn produces an economy because the gas 52 need not be compressed to as high a pressure as heretofore required. It should also be noted that as the gas 52 exits from the slot 54 into the reduced pressure area 88, its velocity accelerates because of the reduced pressure in the area 88. Further, the rotational movement of the impeller tends to pump the gas 52 out through the slot 54. As a result, the gas pressure may be even lower or selected to achieve greater penetration into the slurry as desired. It may also be noted that the turbulence created radially outward of the low pressure zone 88 by the intermixing or cross-mixing hereinbefore described provides an excellent area for intermixing of the gas with the medium or slurry 28. In addition, introducing the gas at the rim does not interfere with the efficiency of the pumping action of the flutes 12 and 14. That is, in impellers heretofore known the gas is introduced in such a manner that the efficiency of the pumping action is reduced in that a combined gas and slurry/medium is pumped by the impeller/propeller because the air or gas is introduced at or near the eye of the impeller (adjacent the hub 10). It may also be noted that by introducing the gas at the rim 38, the impeller is not subjected to a gas-liquid interface. This in turn reduces the turbulent wear and erosion associated therewith on impeller structure. Only the small bubbles which may be already entrapped in the slurry come into contact with the surfaces of the flutes 12, 14.

In operation it has been determined that an impeller with a diameter to height ratio from between 10:1 to about 1:1 is preferred for a floation machine having a cell cross-sectional width 96 to impeller diameter ratio from about 1½:1 to about 10:1. Further, for an impeller as above described, it has been determined that the optimum rotational speed of the impeller should be from a peripheral speed of about 2 meters per second to about 15 meters per second. Peripheral speed is the actual linear speed of any point on the rim 38 of the impeller as it rotates. For example, an impeller having a two (2) meter circumference and rotating at a peripheral speed of two (2) meters per second would turn at the rate of one revolution per second.

For the machine and impeller described in the paragraph next above, it has been found that air may be introduced preferably at a relatively low pressure from about 5 pounds per square inch above atmospheric pressure to about ½ pound per square inch above atmospheric pressure. Usually the air pressure may be less than 1½ pounds per square inch above atmospheric pressure. Further, such an impeller may preferably have a gap 50 which may be sized between one millimeter to five millimeters.

It may be noted that the impeller configurations illustrated in FIGS. 1 through 4 act to reduce the tendency to sand-in a flotation machine cell. In the less efficient systems heretofore known, the impeller is typically located closer to the tank bottom 82 to generate more pronounced flow currents near the bottom to produce more thorough mixing. Upon shutdown, the layer of solids on the cell bottom 82 plus the additional solids settling out of a slurry 28, tends to raise the level of solids to and above the bottom of the impeller. That is, there is a tendency to "sand-in" the impeller making a subsequent re-start difficult. Further, for flotation cells using impellers heretofore known, the inefficient mixing leaves heavier particulate matter behind which tends to concentrate the slurry in operation.

As stated herein, the impeller of the instant invention more thoroughly mixes the slurry. The heavier particles tend to be mixed so that less material collects on the cell bottom 82 and the slurry 82 tends to not concentrate. Upon shutdown, fewer solids are available to settle to the bottom. The impeller is therefore generally free of settled solids in a static state and can be started or restarted without the usual problems associated with other impellers known in the art which may become mired in solids which build-up from the bottom of the cell 80. The use of a shroud such as that illustrated in FIGS. 3 and 4 further prevents solids from settling around the impeller and virtually eliminates the sand-in problem for the impeller of the instant invention.

It has also been found that use of the impeller of the instant invention results in significant power savings. For example, a 20 horsepower synchronous AC motor (3 phase, 60HZ) may be used to power simultaneously an impeller in two 100 cubic foot flotation cells. Using an AGITAR*TM* impeller manufactured by the Galigher Company of Salt Lake City, Utah, about 12.85 horsepower are required to operate the two impellers in a water slurry. Using an impeller of the instant invention under similar conditions, only about 9.2 horsepower are required. That is, a net savings of about 29 percent in horsepower required may be realized while experiencing improved mixing as herein set forth. Comparable power savings have been noted for 500 cubic foot flotation cells and may be expected in other sizes of flotation cells.

It may be noted that the impeller and method herein disclosed are very versatile. That is, it can be readily adapted to existing flotation machines and other equipment for which mixing and aeration or gas injection is desirable by adjusting diameter height and rotation speed. A wide range of agitation capacity gas dispersion and froth surface characteristics can thereby be achieved. Further, the self-cleaning aspects of this impeller, by virtue of its flexibility, commend its use for fibrous or random waste materials. That is, the flexing of the impeller and the absence of protruding blades make it virtually impossible to clog this impeller in virtually any medium.

It may also be noted that the descriptions and illustrations herein set forth are merely illustrative of the principles of the invention. Those skilled in the art will recognize that other embodiments may readily be devised in incorporating the principles of the invention set forth in the claims.

I claim:

1. An impeller for rotation in a medium by a shaft comprised of:

hub means connecting said impeller to said shaft for rotation by said shaft in a plane substantially normal to said shaft, said shaft having means to transmit compressed gas to said hub and said hub being formed to receive and transmit said gas;

an upper member and a lower member both adapted to said hub wherein:

said upper and lower members are substantially congruent to each other and spaced apart to form a passage in communication with said hub to receive said compressed gas therefrom, and to form a slot at the outer rim of said impeller to receive said gas from said passage and to discharge said gas outwardly from said impeller, and said upper and lower members are shaped to form a plurality of first flutes interspaced between and joined in a periodic pattern to a plurality of second flutes which are essentially the inverse of said first flutes, said first flutes having a trough which begins proximate said hub and extends radially outward therefrom and downward from said plane at an angle, said second flutes having a trough which begins proximate said hub and extends outward therefrom and upward from said plane at an angle, and said first and second flutes each having opposite sides which are substantially mirror images of each other, and said upper and lower members are formed so the sides of said first and second flutes extend upwardly and downwardly simultaneously with respect to said plane;

wherein said impeller, upon rotation, discharges said slurry angularly downward and upward with respect to said plane from said first and second flutes respectively; and wherein said impeller has a height which is the total axial distance at the rim between the axially uppermost and lowermost impeller structure and wherein the downward angle of said first flutes and upward angle of said second flutes are substantially equal and are selected so that said impeller has a diameter to height ratio from about 20:1 to about 1:1.

2. The impeller of claim 1 wherein said passage is an essentially unobstructed thin gap between said upper and lower members, wherein said slot is a thin slot which extends substantially entirely around the rim of said impeller and from which said gas is discharged into said slurry in directions related to the shape of the upper and lower members, including angularly upward and downward with respect to said plane from the rim portions of said impeller proximate the outward ends of the troughs of said first and second flutes respectively.

3. The impeller of claim 2 wherein said flutes are shaped in a periodic pattern which is generally sinusoidal in cross-section normal to the radius of the impeller along the radial length of said flutes.

4. The impeller of claim 2 wherein said flutes are shaped in a periodic pattern which is generally trapezoidal in cross-section normal to the radius of the impeller along the radial length of said flutes with the sides of the trapezoids being the opposite sides of the flute, a first base of the trapezoid being the trough and a second base being a constructable line interconnecting the said sides at the ends thereof opposite said first base.

5. The impeller of claim 2 wherein said upper and lower members are made of material which is slightly flexible and wherein said diameter to height ratio is from about 10:1 to about 1:1.

6. In a slurry flotation machine of the type having a cell containing a slurry, an impeller rotatable by a shaft to agitate said slurry and which has means to inject gas into said slurry, the improvement wherein said impeller is comprised of:

hub means for adapting said impeller to said shaft for rotation in a plane substantially normal to said shaft, said shaft having means to transmit said gas which is compressed to said hub, and said hub being formed to receive and transmit said gas;

an upper member and a lower member both adapted to said hub wherein:

said upper and lower members are substantially congruent to each other and spaced apart to form a passage in communication with said hub to receive said compressed gas therefrom, and to form a slot at the outer rim of said impeller to receive said gas from said passage and to discharge said gas outwardly from said impeller, and said upper and lower members are shaped to form a plurality of first flutes interspaced between and joined in a periodic pattern to a plurality of substantially similar second flutes which are the inverse of said first flutes, said first flutes having a trough which begins proximate said hub and extends radially outward therefrom and downward from said plane at an angle, said second flutes having a trough which begins proximate said hub and extends outward therefrom and upward from said plane at an angle, and said first and second flutes each having opposite sides which are substantially mirror images of each other, and said upper and lower members are formed so that the sides of said first and second flutes extend upwardly and downwardly simultaneously with respect to said plane;

wherein said impeller, upon rotation, discharges said slurry angularly downward and upward with respect to said plane from said first and second flute respectively; and wherein said impeller has a height which is the total axial distance at the rim between the axially uppermost and lowermost impeller structure and wherein the downward angle of said first flutes and upward angle of said second flutes are substantially equal and are selected so that said impeller has a diameter to height ratio from about 20:1 to about 1:1.

7. The improvement of claim 6 wherein said passage is an essentially unobstructed thin gap between said upper and lower members, and wherein said slot is a thin slot which extends substantially entirely around the rim of said impeller and from which said gas is discharged into said slurry in directions related to the shape of the upper and lower members, including angularly upward and downward with respect to said plane from the rim portions of said impeller proximate the outward ends of the troughs of said first and second flutes respectively.

8. The improvement of claim 7 wherein said flutes are shaped in a periodic pattern which is generally sinusoidal in cross-section normal to the radius of the impeller along the radial length of said flutes.

9. The improvement of claim 7 wherein said flutes are shaped in a periodic pattern which is generally trapezoidal in cross-section normal to the radius of the impeller along the radial length of said flutes with the sides of the trapezoids being the opposite sides of the flute, a first base of the trapezoid being the trough and a second base being a constructable line interconnecting the said sides at the ends thereof opposite said first base.

10. The improvement of claim 7 wherein said upper and lower members are made of material which is slightly flexible and wherein said diameter to height ratio is from about 10:1 to about 1:1.

11. A flotation machine for recovering mineral values from a slurry comprising:

at least one cell containing said slurry;

means associated with said cell to let in slurry;

means associated with said cell to let out gangue;

means associated with said cell to remove froth which has mineral values;

means associated with said cell to process said slurry to froth and gangue, said means including an impeller for rotation by a shaft in said slurry in said cell wherein said impeller is comprised of:

hub means connecting said impeller to said shaft for rotation by said shaft in a plane in said slurry substantially normal to said shaft to form said froth, said shaft having means to transmit compressed gas to said hub and said hub being formed to receive and transmit said gas, an upper member and a lower member both adapted to said hub wherein:

said upper and lower members are substantially congruent to each other and spaced apart to form a passage in communication with said hub to receive said compressed gas therefrom, and to form a slot at the outer rim of said impeller to receive said gas from said passage and to discharge said gas outwardly from said impeller, and said upper and lower members are shaped to form a plurality of first flutes interspaced between and joined in a periodic pattern to a plurality of substantially similar second flutes which are essentially the inverse of said first flutes, said first flutes having a trough which begins proximate said hub and extends radially outward therefrom and downward from said plane at an angle, and said second flutes having a trough which begins proximate said hub and extends outward therefrom and upward from said plane at an angle, said first and second flutes each having opposite sides which are substantially mirror images of each other, and said upper and lower members are formed so that the sides of said first and second flutes extend upwardly and downwardly simultaneously with respect to said plane;

wherein said impeller, upon rotation, discharges said slurry angularly downward and upward with respect to said plane from said first and second flutes respectively; and wherein said impeller has a height which is the total axial distance at the rim between the axially uppermost and lowermost impeller structure and wherein the downward angle of said first flutes and upward angle of said second flutes are substantially equal and are selected so that said impeller has a diameter of height ratio from about 20:1 to about 1:1.

12. The flotation machine of claim 11 wherein said passage is an essentially unobstructed thin gap between said upper and lower members, and wherein said slot is a thin slot which extends substantially entirely around the rim of said impeller and from which said gas is discharged into said slurry in directions related to the shape of the upper and lower members, including angularly upward and downward with respect to said plane from the rim portions of said impeller proximate the outward ends of the troughs of said first and second flutes respectively.

13. The flotation machine of claim 12 wherein said flutes are shaped in a periodic pattern which is generally sinusoidal in cross-section normal to the radius of the impeller along the radial length of said flutes.

14. The flotation machine of claim 12 wherein said flutes are shaped in a periodic pattern which is generally trapezoidal in cross-section normal to the radius of the impeller along the radial length of said flutes with the sides of the trapezoids being the opposite sides of the flute, a first base of the trapezoid being the trough and a second base being a constructable line interconnecting the said sides at the ends thereof opposite said first base.

15. The flotation machine of claim 12 wherein said diameter to height ratio is from about 10:1 to about 1:1 and wherein said cell has a cross-sectional width and a cross-sectional width to impeller diameter ratio from about one and one-half to one (1-½:1) to about ten to one (10:1).

16. The flotation machine of claim 15 wherein said upper and lower members are made of material which is slightly flexible, and wherein shroud means is positioned proximate said impeller, said shroud means having a plurality of radially oriented fins positioned about the perimeter of said impeller.

17. A method of agitating a slurry containing mineral values within a flotation machine cell to produce a froth having mineral values and gangue, said method being comprised of:

positioning an impeller rotatable by a shaft in said slurry in said cell, said impeller being of the type having:

hub means connecting said impeller to said shaft for rotation by said shaft in a plane substantially normal to said shaft, said shaft having means to transmit compressed gas to said hub and said hub being formed to receive and transmit said gas;

an upper member and a lower member both adapted to said hub wherein:

said upper and lower members are substantially congruent to each other and spaced apart to form a thin passage in communication with said hub to receive said compressed gas therefrom, and to form a thin slot which extends substantially entirely around said impeller at the outer rim thereof to receive said gas from said passage and to discharge said gas outwardly from said impeller, and said upper and lower members are shaped to form a plurality of first flutes interspaced between and joined in a periodic pattern to a plurality of substantially similar second flutes which are essentially the inverse of said first flutes, said first flutes having a trough which begins proximate said hub and extends radially outward therefrom and downward from said plane at an angle, said second flutes having a trough which begins proximate said hub and extends outward therefrom and upward from said plane at an angle, and said first and second flutes each having opposite sides which are substantially mirror images of each other, and said upper and lower members are formed so that the sides of said first and second flutes extend upwardly and downwardly simultaneously with respect to said plane;

wherein said impeller has a height which is the total axial distance at the rim between the axially uppermost and lowermost impeller structure and wherein the downward angle of said first flutes and upward angle of said second flutes are substantially equal and are selected so that said impeller has a diameter to height ratio from about 20:1 to about 1:1;

rotating said impeller in said slurry in said cell to cause a suction proximate the beginning of said trough of said first flutes to pump slurry from above said plane to discharge angularly downward from said plane, and to cause a suction proximate the beginning of said trough of said second flutes to pump slurry from below said plane to discharge angularly upward from said plane; and injecting a gas from said shaft into said hub at a pressure above atmospheric pressure from about five pounds per square inche (5 psi) to about one-half pound per square inch (½ psi) to be pumped and discharged therefrom upon rotation of said impeller in directions related to the shape of the upper and lower members, including angularly upward and downward with respect to said plane from the rim portions of said impeller proximate said first and second flutes.

18. The method of claim 17 wherein said impeller has a diameter to height ratio of from about ten to one (10:1) to about one to one (1:1) and said cell and impeller are selected to have a cell cross-sectional width to impeller diameter ratio from about one and one-half to one (1-½:1) to about ten to one (10:1), and wherein said impeller is rotated at a rate so that its peripheral speed is from about two (2) meters per second to about fifteen (15) meters per second.

* * * * *